US007138959B2

(12) United States Patent
Gaudette et al.

(10) Patent No.: US 7,138,959 B2
(45) Date of Patent: Nov. 21, 2006

(54) METHOD FOR IMPROVING ISOLATION OF AN ANTENNA MOUNTED ON A STRUCTURE

(75) Inventors: Yves Gaudette, St-Lazare (CA); Yan Brand, Ile Bizard (CA)

(73) Assignee: EMS Technologies Canada, Ltd., Ste-Anne-de-Bellevue ( * ) Notice: Subject to any disclaimer, the term of this patent is extended or adjusted under 35 U.S.C. 154(b) by 114 days.

(21) Appl. No.: 10/747,278

(22) Filed: Dec. 30, 2003

(65) Prior Publication Data

US 2004/0150580 A1 Aug. 5, 2004

Related U.S. Application Data

(60) Provisional application No. 60/436,626, filed on Dec. 30, 2002.

(51) Int. Cl.
*H01Q 1/12* (2006.01)
*H01Q 21/00* (2006.01)
*H01Q 3/02* (2006.01)

(52) U.S. Cl. ..... 343/878; 343/879; 343/882

(58) Field of Classification Search ..... 343/702–703, 343/705, 718, 757–758, 893, 878–879, 882, 343/888, 892

See application file for complete search history.

(56) References Cited

U.S. PATENT DOCUMENTS

| | | | | |
|---|---|---|---|---|
| 5,264,862 | A | 11/1993 | Kumpfbeck | 343/853 |
| 5,644,320 | A * | 7/1997 | Rossi | 343/702 |
| 5,764,194 | A * | 6/1998 | Brown | 343/726 |
| 6,049,315 | A | 4/2000 | Meyer | 343/895 |
| 6,917,344 | B1 * | 7/2005 | Zimmerman et al. | 343/841 |

* cited by examiner

*Primary Examiner*—Thuy Vinh Tran
(74) *Attorney, Agent, or Firm*—Equinox Int'l; Franz Bonsang, Patent Agent

(57) ABSTRACT

A method for improving the electric isolation of a wide coverage antenna mounted on a structure. The structure defines a peripheral wall and a first end wall and the elongated antenna has a base. The antenna pivotally mounts on the structure about a mounting axis parallel to the structure axis, in a spaced apart relationship relative to the peripheral wall in a direction pointing generally outwardly therefrom with the antenna base and at least part of an antenna body being in a step back relationship relative to the first end wall such that the antenna is at least partially electrically isolated by the structure while being substantially hidden from the first end wall. A second antenna similarly pivotally positioned relative to the peripheral wall can be generally opposed to the first antenna about the structure such that the two antennas are at least partially electrically isolated from one another.

16 Claims, 2 Drawing Sheets

METHOD FOR IMPROVING ISOLATION OF AN ANTENNA MOUNTED ON A STRUCTURE

CROSS REFERENCE TO RELATED APPLICATIONS

Benefit of U.S. Provisional Application for Patent Ser. No. 60/436,626, filed on Dec. 30, 2002, is hereby claimed.

FIELD OF THE INVENTION

The present invention relates to the field of antennas and is more particularly concerned with a method for improving the electric isolation of an antenna by its mounting position on a structure, and the relatively positioned antenna itself.

BACKGROUND OF THE INVENTION

It is well known in the art to use antennas mounted on a structure to allow communication with equipment located at a distance away. More specifically in the aerospace industry, global coverage antennas, including omni-directional antennas, are conventionally mounted on spacecraft structure to allow specific communications to and from the ground through a ground station on Earth. Accordingly, spacecraft mounted global coverage antennas are usually located on the conventionally called earth facing panel of the spacecraft to improve their signal gain and their reliability.

With continuously increasing required antenna gain on spacecrafts, the global coverage antennas get larger and, depending on their signal frequency range, often need to be isolated electrically from other antennas or the like equipment located nearby on the spacecraft, especially because of their substantially wide coverage angle. Accordingly, significant mechanical and electrical problems need to be solved; especially when considering the complex and stringent mechanical and electrical environments the antennas encounter or need to survive. The solution to these problems often requires some trade-offs to be made with the antenna gain, or any other specific requirement the antennas need to meet.

Typically, these antennas need to be located as far as possible from any surrounding sensitive equipment or structure, such as electronic or radio-frequency (RF) equipments, solar panels and the like so as to improve their electric isolation, especially for receive-type antennas which are more susceptible electromagnetic interferences (EMI) and electromagnetic signal reflections on adjacent structures that could generate the commonly known Passive Inter-Modulation (PIM) products. Accordingly, they are usually mounted on rather expensive deployable support structure including hinges or the like. The more hinges are used, the less reliable the support structure deployment mechanism is, and the more expensive it is, both design and manufacturing wise.

Similarly, the larger the antennas are, the more likely they have to include antenna deployment mechanisms, which is not a preferred design approach.

Accordingly, there is a real need for a method that improves the isolation of an antenna mounted on a structure.

SUMMARY OF THE INVENTION

It is therefore a general object of the present invention to provide a method for improving the electric isolation of an antenna mounted on a structure.

An advantage of the present invention is that the method uses the structure body it is mounted on as a physical barrier to at least partially isolate the global coverage antenna from the surrounding equipment, especially to at least partially isolate a receive antenna from a transmit antenna by having the structure located there between.

Another advantage of the present invention is that the method position of the antenna relative to the structure body allows a relatively low level of the scattering effect of the surrounding structure and equipment on the antenna signal.

A further advantage of the present invention is that the method allows the antenna to be positioned relatively close to the structure body so as to ease the design of the antenna and its deployable supporting structure, while minimizing the effects on the deterioration of the antenna signal.

Still another advantage of the present invention is that the method reduces the complexity of any deployment mechanism while increasing the overall reliability of the antenna.

Another advantage of the present invention is that the method allows the antenna support structure deployment mechanism to be located far from any other sensitive equipment mounted on the structure body so as to minimize the risk of interference therewith.

According to an aspect of the present invention, there is provided a method for improving the isolation of a wide coverage antenna mounted on a structure, the structure having a body, said body defining a first end wall perpendicular to a body axis and a peripheral wall surrounding said body axis, said first end wall defining a first external wall surface, said peripheral wall defining a peripheral external wall surface, said antenna having a generally elongated antenna body mounted on and extending from an antenna base along an antenna pointing axis, said antenna base pivotally mounting on the peripheral wall about a mounting axis parallel to and spaced apart from the structure body axis, said antenna being oriented in a direction pointing generally outwardly from said first wall surface with said antenna axis being generally parallel to and spaced apart from said mounting axis and the structure body axis, said method comprises the step of:

positioning said antenna in a spaced apart relationship relative to said peripheral external wall surface in a direction pointing generally outwardly therefrom and away from the structure body axis, and positioning said antenna base in a spaced apart relationship relative to said first wall surface in a direction pointing generally inwardly therefrom such that said antenna is at least partially electrically isolated by said structure body while being substantially hidden from said first wall surface.

In one embodiment, the structure body defines a second end wall generally opposed to the first end wall, and the step of said method further includes positioning said antenna on said structure body adjacent said second end wall.

In one embodiment, the peripheral wall includes at least two peripheral surface sections, said two peripheral wall sections defining a generally rectilinear outer corner intersection therebetween, said method further comprises the step of:

pivoting said antenna about said mounting axis in a spaced apart relationship relative to said outer intersection in a direction pointing outwardly away from said two peripheral wall sections such that said antenna is closer to said outer intersection than to either one of said two peripheral wall sections.

Typically, the step of said method includes:

positioning said antenna base is positioned in a spaced apart relationship relative to said first wall surface in a direction pointing generally inwardly therefrom such that at least half of a length of said antenna is hidden from said first wall surface.

In one embodiment, the step of said method includes:

positioning said antenna base is positioned in a spaced apart relationship relative to said first wall surface in a direction pointing generally inwardly therefrom such that said antenna is totally hidden from said first wall surface.

In one embodiment, the antenna is a first antenna having a first antenna body defining a first antenna axis and a first antenna base and a first mounting axis, a second wide coverage antenna for pivotally mounting on the peripheral wall about a second mounting axis parallel to and spaced apart from the structure body axis having an elongated second antenna body mounted on and extending from a second antenna base along a second longitudinal antenna pointing axis, said second antenna being oriented in a direction pointing outwardly away from said first wall surface with said second antenna axis being parallel to and spaced apart from the structure axis and said second mounting axis, said method further includes the step of:

positioning said second antenna in a spaced apart relationship relative to said peripheral external wall surface in a direction pointing generally outwardly therefrom and away from the structure body axis, and positioning said second antenna base in a spaced apart relationship relative to said first wall surface in a direction pointing generally inwardly therefrom such that said second antenna is at least partially electrically isolated by said structure body while being substantially hidden from said first wall surface.

Typically, the method further includes the step of:

positioning said second antenna in a generally opposed relationship relative to said first antenna about said body axis such that said first and second antennas are at least partially electrically isolated from one another by said structure body.

Typically, the peripheral wall includes at least four peripheral surface sections, said four peripheral wall sections defining at least two generally opposed and rectilinear outer corner intersections therebetween, said method further comprises the step of:

pivoting said first and second antennas about respective said mounting axis in a spaced apart relationship relative to a respective of said two outer intersections in a direction pointing outwardly away from said four peripheral wall sections such that said first and second antennas are closer to said respective outer intersection than to any one of said four peripheral wall sections.

Typically, the two generally opposed outer intersections are in a generally opposed relationship relative to one another about said body axis.

According to another aspect of the present invention, there is provided a wide coverage antenna for mounting on a structure, the structure having a structure body, said structure body defining a first end wall perpendicular to a structure body axis and a peripheral wall surrounding said structure body axis, said first end wall defining a first external wall surface, said peripheral wall defining a peripheral external wall surface, said antenna comprises: an antenna base for pivotally mounting on the peripheral wall about a mounting axis parallel to and spaced apart from the structure body axis: an elongated antenna body mounting on and extending from said antenna base along an antenna pointing axis, said antenna body being oriented in a direction pointing generally outwardly from said first wall surface with said antenna axis being generally parallel to and spaced apart from said mounting axis and the structure body axis: said antenna being positioned in a spaced apart relationship relative to said peripheral external wall surface in a direction pointing generally outwardly therefrom and away from the structure body axis with said antenna base being in a spaced apart relationship relative to said first wall surface in a direction pointing generally inwardly therefrom such that said antenna is at least partially electrically isolated by said structure body while being substantially hidden from said first wall surface.

Typically, the antenna further includes a mounting boom, said mounting boom having opposite first and second boom ends, said first boom end being secured to said antenna base, said second boom end being for pivotally mounting on said peripheral wall about said mounting axis.

Typically, the antenna is for pivotally mounting on said structure body about said mounting axis between a stowed configuration with said antenna being in proximity to said peripheral wall and a deployed configuration with said antenna being generally away from said peripheral wall.

In one embodiment, the peripheral wall includes at least two peripheral surface sections, said two peripheral wall sections defining a generally rectilinear outer intersection therebetween, said antenna being in a spaced apart relationship relative to said outer intersection in a direction pointing outwardly from said two peripheral wall sections when in said deployed configuration such that said antenna is closer to said outer intersection than to either one of said two peripheral wall sections.

According to a further aspect of the present invention, there is provided a combination of a first wide coverage antenna as defined hereinabove and a second wide coverage antenna for mounting on the structure, said second antenna comprises: a second antenna base for pivotally mounting on the peripheral wall about a second mounting axis parallel to and spaced apart from the structure axis; a second elongated antenna body mounting on and extending from said second antenna base along a second antenna pointing axis, said second antenna body being oriented in a direction pointing generally outwardly from said first wall surface with said second antenna axis being generally parallel to and spaced apart from said second mounting axis and the structure body axis; said first and second antennas being positioned in a spaced apart relationship relative to said peripheral external wall surface in a direction pointing generally outwardly therefrom and away from the structure body axis with said first and second antenna bases being in a spaced apart relationship relative to said first wall surface in a direction pointing generally inwardly therefrom such that said first and second antennas are at least partially electrically isolated by said structure body while being substantially hidden from said first wall surface.

Typically, the first and second antennas are in a generally opposed relationship relative to one another about said body axis such that said first and second antennas are at least partially electrically isolated from one another by said structure body.

In one embodiment, the peripheral wall includes at least four peripheral surface sections, said four peripheral wall sections defining at least two generally opposed and rectilinear outer intersections therebetween, said first and second antennas being in a spaced apart relationship relative to a respective of said two outer intersections in a direction pointing outwardly from said four peripheral wall sections such that said first and second antennas are closer to said respective outer intersection than to any one of said four peripheral wall sections.

Other objects and advantages of the present invention will become apparent from a careful reading of the detailed description provided herein, with appropriate reference to the accompanying drawings.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
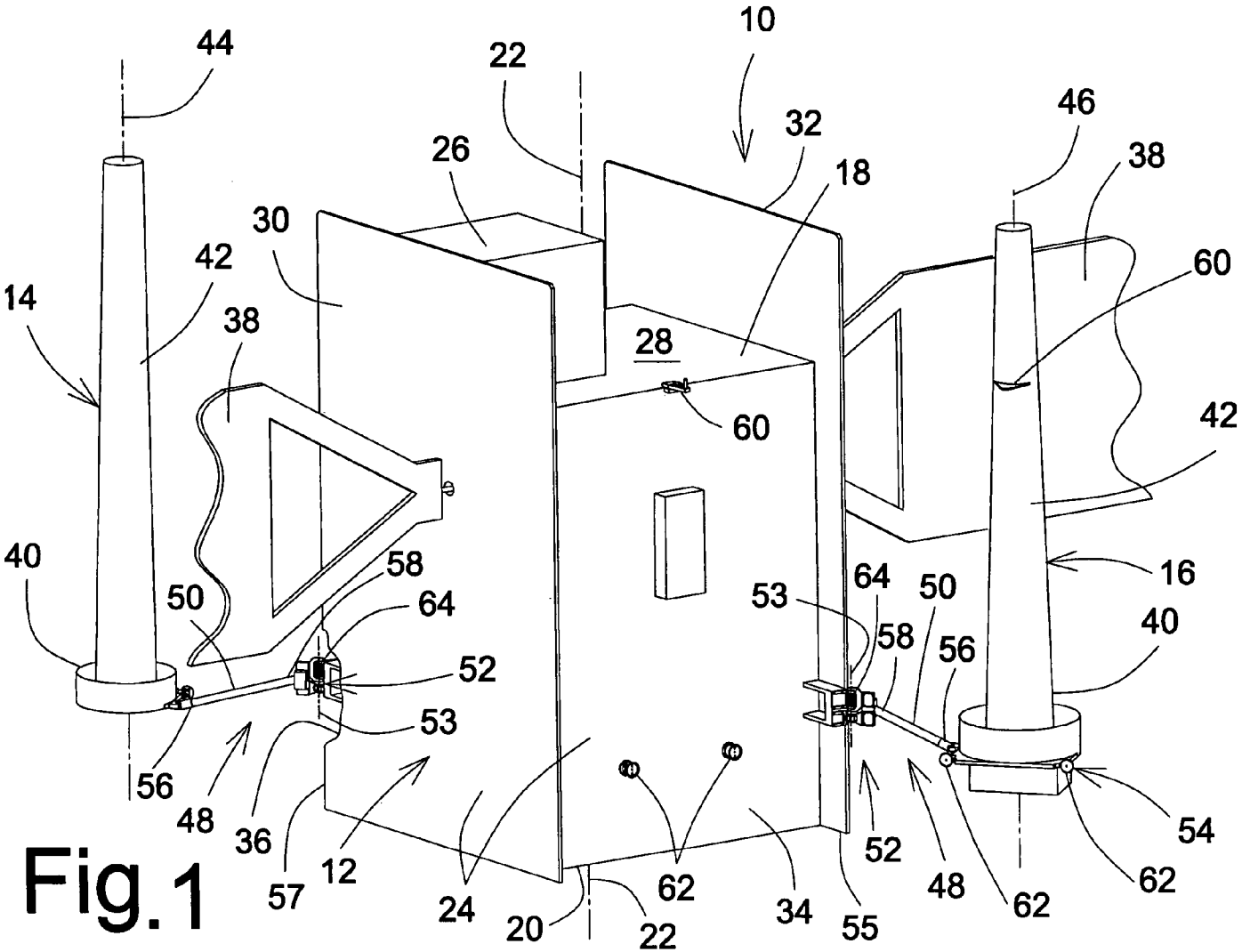
FIG. 1 is a partially broken perspective view, showing two omni-directional antennas oppositely mounted on a spacecraft structure with a method for improving their electric isolation in accordance with an embodiment of the present invention.

Referring to FIG. 1, there is schematically shown a spacecraft structure 10 which defines a generally elongated body 12 with a receive (Rx) antenna 14 and a transmit (Tx) antenna 16 mounted thereon. Both the Rx and Tx antennas 14, 16 are typically wide coverage antennas, most conventionally called global or earth coverage antennas. Any other type of antennas, such as omni-directional antennas or the like, could also be considered without departing from the scope of the present invention, as it would be obvious to one skilled in the art.

The spacecraft structure body 12 defines generally opposed first and second longitudinal end walls 18, 20 and a body axis 22. The body 12 further defines a peripheral wall 24 generally extending between the first and second end walls 18, 20.

The first end wall 18 is conventionally called the earth facing panel or deck of the spacecraft 10 and usually includes a few communication equipment, schematically represented by reference sign 26, mounted on its generally planar external surface 28. The second end wall 20 usually makes reference to the separation plane since the spacecraft 10 is generally secured to its launcher fairing (not shown) via that second end wall 20 and separates from the fairing shortly after launch.

The peripheral wall 24 is generally divided into four wall sections referred to as the north 30, south 32, east 34 and West 36 panels. The north and south panels 30, 32 are usually radiator panels with solar panels 38 extending generally outwardly and perpendicularly therefrom, while the east and west panels 34, 36 supports the side mounted antennas 16, 14, respectively.

Both the Rx and Tx antennas 14, 16 define a corresponding antenna base 40 from which a generally elongated antenna body 42 extends to have the antenna 14, 16 generally pointing in the direction of the Earth (not shown) to receive and transmit electromagnetic signal thereto, respectively, such that their respective axis 44, 46 are generally parallel to the spacecraft axis 22.

In order to improve the electric isolation of each antenna 14, 16 from any equipment 28 mounted on the earth facing panel 18 and more specifically from each other, they are mounted beside the structure body 12 on opposite sides thereof, with their base 40 being spaced apart from the earth facing panel 18 in a direction pointing generally inwardly from its external surface 28, i.e. in a step back configuration relative to or below the earth facing panel 18.

Accordingly, the Rx and Tx antennas 14, 16 are mounted on the peripheral wall 24, at locations adjacent the separation plane 20 so as to limit the protrusion, or extension, of their respective antenna body 42 beyond the earth facing panel 18; the spacecraft body 12 acting as a screen or barrier for their electric isolation. Typically the antennas 14, 16 are positioned relative to the earth facing panel 18 such that the antenna bodies 42 are as much as possible below the general level of the earth facing panel 18; preferably, at least between half (½) and three quarter (¾) of the length of the antenna 14, 16 is located below the general level of the earth facing panel 18.

In order to minimize the scattering effect of the spacecraft body 12 and other major surrounding structures such as the solar panels 38 on the signal of the antennas 14, 16, the latter are typically positioned in a spaced apart relationship relative to the spacecraft body 12 in a direction pointing outwardly from the external surface of the peripheral wall 24.

Figure 2:
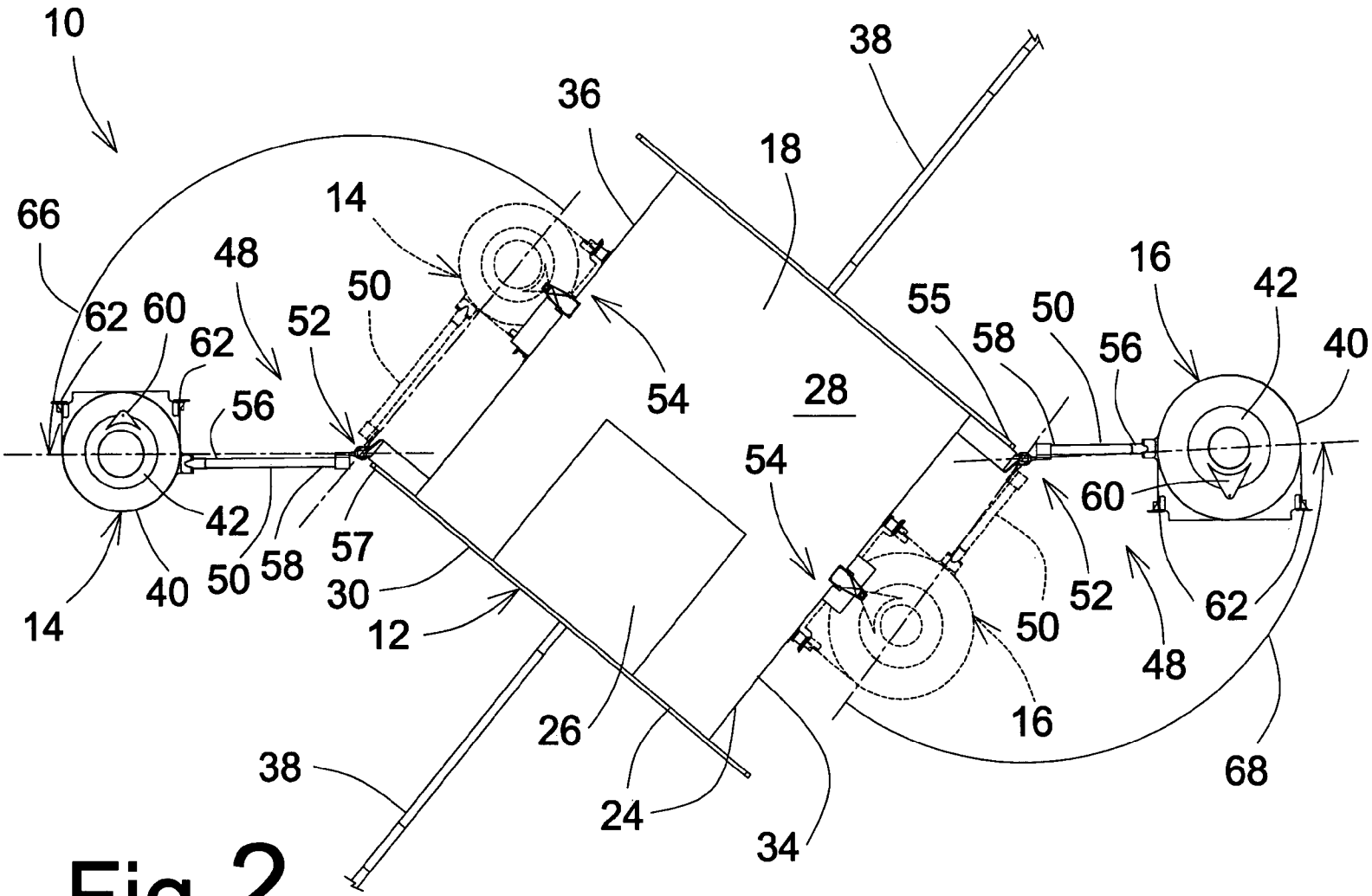
FIG. 2 is a partially broken top plan view of FIG. 1, illustrating the positions of the two antennas relative to the spacecraft structure in their deployed configuration, the respective antennas being illustrated in their stowed configuration in dashed lines.

Accordingly, each antenna 14, 16 is typically mounted on the spacecraft 10 using a relatively simple boom deployment mechanism 48 which allows the corresponding antenna 14, 16 to be displaced from a stowed or launch configuration in proximity to the spacecraft body 12, as shown in dashed lines in FIG. 2, to a deployed or flight configuration generally away from the spacecraft body 12, as shown in solid lines in FIGS. 1 and 2.

The stowed configuration allows to have full size rigid antennas 14, 16 directly mounted on the spacecraft 10 that fit into the spacecraft envelope inside the launcher fairing (not shown), thereby eliminating the need of having an additional deployment mechanism to further deploy the antenna itself.

The boom deployment mechanism 48, similar for both Rx and Tx antennas 14, 16, includes a mounting or supporting boom 50, a hinge assembly 52 and a hold-down and release mechanism 54 (HRM). The boom 50 defines generally opposed first and second boom longitudinal ends 56, 58. The boom first end 56 is secured to the antenna base 40 and the boom second end 58 is pivotally mounted on the hinge assembly 52 about a mounting axis 53 generally parallel to the spacecraft axis 22. The hold-down and release mechanism 54 includes upper 60 and lower 62 brackets with corresponding pin pullers, separation nuts (not shown) or the like mechanisms used to retain the corresponding antenna 14, 16 in stowed configuration. The hinge assembly 52 includes a biasing means, such as a spring 64 or the like, biasing the antenna 14, 16 in the deployed configuration and an abutment means, or latching means (not shown), to maintain and/or lock the antenna 14, 16 in the deployed configuration. The pin pullers, separation nuts are usually activated by a releasing mechanism (not shown) to release the antenna 14, 16 from the stowed configuration, then the spring 64 biases the antenna 14, 16 in the deployed configuration. When in the deployed configuration, the antenna 14, 16 is locked in that position by the latching means.

In the stowed configuration, the boom 50 is in a generally parallel relationship relative to the corresponding spacecraft east 34 or west 36 panel with the boom second end 58 and the hinge assembly 52 generally adjacent an outer intersection 55, 57, or corner formed, between two adjacent panels 32, 34 and 30, 36 of the peripheral wall 24.

Accordingly, the Rx and Tx antennas 14, 16 deploy from their stowed configuration to their deployed configuration by the deployment angle 66, 68, respectively. Depending on the configuration of the antennas 14, 16, the spacecraft body 12 and other equipment 36 and/or solar panels 38, the predetermined deployment angles 66, 68 may be anywhere between substantially zero (0) and two hundred and seventy (270) degrees. More typically, the deployment angles are between substantially ninety (90) and one hundred and eighty (180) degrees, so as to be generally closer to the generally opposed corner 55, 57 than to either one of the two adjacent panels 32, 34 or 30, 36 forming the corner 55, 57.

In the embodiment illustrated in FIGS. 1 and 2, the scattering effect on the antenna beams is minimized with deployment angles 66, 68 being between substantially one hundred (100) and one hundred and thirty (130) degrees. These positions of the Rx and Tx antennas 14, 16 allow them to be closer than usual to the spacecraft body 12 with the booms 50 shorter than usual; thus improving the overall mass and structural behavior of the antennas 14, 16 and consequently the overall spacecraft 12 performance and reliability.

Although the two deployment angles 66, 68 are not necessarily identical, they are typically similar such that the two antennas 14, 16 are generally opposed from each other with the spacecraft body 12 there between. These positions significantly improve the electric isolation of the two antennas 14, 16, especially from one another; while reducing the risk of commonly known Passive Inter-Modulation (PIM) products affecting the Rx antenna 14.

The above described method for improving the electric isolation of the antennas 14, 16 mounted on the spacecraft structure 12 by relatively positioning the antenna 14, 16 with respect to the spacecraft body 12 and its earth facing panel 18 significantly simplifies the electric and mechanical design thereof with minimum impact on the antenna gain while increasing its overall reliability because of the relatively simple boom deployment mechanism 48.

Although the above description makes reference to a spacecraft structure 10, any type of structure on which antennas can be mounted such as a transmission tower, a building or the like with polyhedral or cylindrical shape could be similarly considered without departing from the scope of the present invention; such that the antennas are mounted on the side of the structure and set back relative to the first end wall 18 so as to be at least partially invisible or hidden there from. Similarly, it would be obvious to one skilled in the art that, whenever present, any type of deployment mechanism, including any antenna deployment, could be considered without departing from the scope of the present invention, although some mass and design complexity are added to the antenna.

Although the present wide coverage antenna mounted on a structure and the corresponding method for improving its electric isolation when mounted thereon has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A method for improving the isolation of a wide coverage antenna mounted on a structure, the structure having a body, said body defining a first end wall perpendicular to a body axis and a peripheral wall surrounding said body axis, said first end wall defining a first external wall surface, said peripheral wall defining a peripheral external wall surface, said antenna having a generally elongated antenna body mounted on and extending from an antenna base along an antenna pointing axis, said antenna base pivotally mounting on the peripheral wall about a mounting axis parallel to and spaced apart from the structure body axis, said antenna being oriented in a direction pointing generally outwardly from said first wall surface with said antenna axis being generally parallel to and spaced apart from said mounting axis and the structure body axis, said method comprising the step of:

positioning said antenna in a spaced apart relationship relative to said peripheral external wall surface in a direction pointing generally outwardly therefrom and away from the structure body axis, and positioning said antenna base in a spaced apart relationship relative to said first wall surface in a direction pointing generally inwardly therefrom such that said antenna is at least partially electrically isolated by said structure body while being substantially hidden from said first wall surface.

2. The method of claim 1, wherein said structure body defines a second end wall generally opposed to the first end wall, and the step of said method further includes positioning said antenna on said structure body adjacent said second end wall.

3. The method of claim 1, wherein said peripheral wall includes at least two peripheral surface sections, said two peripheral wall sections defining a generally rectilinear outer corner intersection therebetween, said method further comprising the step of:

pivoting said antenna about said mounting axis in a spaced apart relationship relative to said outer intersection in a direction pointing outwardly away from said two peripheral wall sections such that said antenna is closer to said outer intersection than to either one of said two peripheral wall sections.

4. The method of claim 1, wherein said step of said method includes:

positioning said antenna base is positioned in a spaced apart relationship relative to said first wall surface in a direction pointing generally inwardly therefrom such that at least half of a length of said antenna is hidden from said first wall surface.

5. The method of claim 1, wherein said step of said method includes:

positioning said antenna base is positioned in a spaced apart relationship relative to said first wall surface in a direction pointing generally inwardly therefrom such that said antenna is totally hidden from said first wall surface.

6. The method of claim 1, wherein said antenna is a first antenna having a first antenna body defining a first antenna axis and a first antenna base and a first mounting axis, a second wide coverage antenna for pivotally mounting on the peripheral wall about a second mounting axis parallel to and spaced apart from the structure body axis having an elongated second antenna body mounted on and extending from a second antenna base along a second longitudinal antenna pointing axis, said second antenna being oriented in a direction pointing outwardly away from said first wall surface with said second antenna axis being parallel to and spaced apart from the structure axis and said second mounting axis, said method further including the step of:

positioning said second antenna in a spaced apart relationship relative to said peripheral external wall surface in a direction pointing generally outwardly therefrom and away from the structure body axis, and positioning said second antenna base in a spaced apart relationship relative to said first wall surface in a direction pointing generally inwardly therefrom such that said second antenna is at least partially electrically isolated by said structure body while being substantially hidden from said first wall surface.

7. The method of claim 6, further including the step of positioning said second antenna in a generally opposed relationship relative to said first antenna about said body axis such that said first and second antennas are at least partially electrically isolated from one another by said structure body.

8. The method of claim 6, wherein said peripheral wall includes at least four peripheral surface sections, said four peripheral wall sections defining at least two generally opposed and rectilinear outer corner intersections therebetween, said method further comprising the step of:

pivoting said first and second antennas about respective said mounting axis in a spaced apart relationship relative to a respective of said two outer intersections in a direction pointing outwardly away from said four peripheral wall sections such that said first and second antennas are closer to said respective outer intersection man to any one of said four peripheral wall sections.

9. The method of claim 8, wherein said two generally opposed outer intersections are in a generally opposed relationship relative to one another about said body axis.

10. A wide coverage antenna for mounting on a structure, the structure having a structure body, said structure body defining a first end wall perpendicular to a structure body axis and a peripheral wall surrounding said structure body axis, said first end wall defining a first external wall surface, said peripheral wall defining a peripheral external wall surface, said antenna comprising:

an antenna base for pivotally mounting on the peripheral wall about a mounting axis parallel to and spaced apart from the structure body axis;

an elongated antenna body mounting on and extending from said antenna base along an antenna pointing axis, said antenna body being oriented in a direction pointing generally outwardly from said first wall surface with said antenna axis being generally parallel to and spaced apart from said mounting axis and the structure body axis;

said antenna being positioned in a spaced apart relationship relative to said peripheral external wall surface in a direction pointing generally outwardly therefrom and away from the structure body axis with said antenna base being in a spaced apart relationship relative to said first wall surface in a direction pointing generally inwardly therefrom such that said antenna is at least partially electrically isolated by said structure body while being substantially hidden from said first wall surface.

11. The antenna of claim 10, further including a mounting boom, said mounting boom having opposite first and second boom ends, said first boom end being secured to said antenna base, said second boom end being for pivotally mounting on said peripheral wall about said mounting axis.

12. The antenna of claim 11, wherein said antenna is for pivotally mounting on said structure body about said mounting axis between a stowed configuration with said antenna being in proximity to said peripheral wall and a deployed configuration with said antenna being generally away from said peripheral wall.

13. The antenna of claim 12, wherein said peripheral wall includes at least two peripheral surface sections, said two peripheral wall sections defining a generally rectilinear outer intersection therebetween, said antenna being in a spaced apart relationship relative to said outer intersection in a direction pointing outwardly from said two peripheral wall sections when in said deployed configuration such that said antenna is closer to said outer intersection than to either one of said two peripheral wall sections.

14. A combination of a first wide coverage antenna as defined in claim 10 and a second wide coverage antenna for mounting on the structure, said second antenna comprising:

a second antenna base for pivotally mounting on the peripheral wall about a second mounting axis parallel to and spaced apart from the structure axis;

a second elongated antenna body mounting on and extending from said second antenna base along a second antenna pointing axis, said second antenna body being oriented in a direction pointing generally outwardly from said first wall surface with said second antenna axis being generally parallel to and spaced apart from said second mounting axis and the structure body axis;

said first and second antennas being positioned in a spaced apart relationship relative to said peripheral external wall surface in a direction pointing generally outwardly therefrom and away from the structure body axis with said first and second antenna bases being in a spaced apart relationship relative to said first wall surface in a direction pointing generally inwardly therefrom such that said first and second antennas are at least partially electrically isolated by said structure body while being substantially hidden from said first wall surface.

15. The combination of claim 14, wherein said first and second antennas are in a generally opposed relationship relative to one another about said body axis such that said first and second antennas are at least partially electrically isolated from one another by said structure body.

16. The combination of claim 15, wherein said peripheral wall includes at least four peripheral surface sections, said four peripheral wall sections defining at least two generally opposed and rectilinear outer intersections therebetween, said first and second antennas being in a spaced apart relationship relative to a respective of said two outer intersections in a direction pointing outwardly from said four peripheral wall sections such that said first and second antennas are closer to said respective outer intersection than to any one of said four peripheral wall sections.

* * * * *